US006767237B1

(12) United States Patent
Shih

(10) Patent No.: US 6,767,237 B1
(45) Date of Patent: Jul. 27, 2004

(54) POWER CORD ANCHORING STRUCTURE

(75) Inventor: Shoei-Yuan Shih, Shijr (TW)

(73) Assignee: Evserv Tech Corporation, Shijr (TW)

( * ) Notice: Subject to any disclaimer, the term of this patent is extended or adjusted under 35 U.S.C. 154(b) by 0 days.

(21) Appl. No.: 10/462,655

(22) Filed: Jun. 17, 2003

(51) Int. Cl.[7] ..... H01R 13/62
(52) U.S. Cl. ..... 439/371; 439/373
(58) Field of Search ..... 439/371, 373, 439/345, 372, 484

(56) References Cited

U.S. PATENT DOCUMENTS 5,323,845 A * 6/1994 Kin-shon ..... 165/80.3
5,448,449 A * 9/1995 Bright et al. ..... 361/704
5,593,313 A * 1/1997 Shibuya et al. ..... 439/373
5,860,827 A * 1/1999 Lee ..... 439/373
6,101,091 A * 8/2000 Baik ..... 361/704
6,176,728 B1 * 1/2001 Bonnet et al. ..... 439/362

* cited by examiner

*Primary Examiner*—Hien Vu
(74) *Attorney, Agent, or Firm*—Birch, Stewart, Kolasch & Birch, LLP

(57) ABSTRACT

A power cord anchoring structure for clipping a power cord securely includes a holding section to clip the power cord, a confining section to confine the power cord in the holding section, a support section and a connecting section connecting in a biased manner, and a coupling section to engage with a power supply. The clipping condition of the holding section at the front end of the anchoring structure does not affect the engagement of the coupling section and the power supply.

5 Claims, 4 Drawing Sheets

POWER CORD ANCHORING STRUCTURE

FIELD OF THE INVENTION

The present invention relates to a power cord anchoring structure and particularly to an anchoring structure that has a holding section and a confining section to clip the power cord of a power supply.

BACKGROUND OF THE INVENTION

Power supply is one of the important elements of computer power source. The power supply mainly transforms AC power of 110/220 volts to DC power of 5V and 12V suitable for the main board and peripheral devices such disk drives of computers. A conventional power supply usually is fastened to the rear side of the host casing through fastening elements (generally are screws). Then a power cord is connected to the power supply and a socket to supply electric power. To avoid the power cord from loosening and dropping from the power supply, a power cord anchoring structure generally is provided to anchor the power cord on the power supply.

Refer to FIG. 1 for a conventional power cord anchoring structure. It includes a ⊓-shape holding section, a maintaining section bending and extending from two ends of the holding section, a support section connecting to the maintaining section and a coupling section extending from the support section. When in use, the coupling section is engaged with the power supply, and the ⊓-shape holding section clips the power cord securely. However, such a structure still has disadvantages remained to be improved, notably:

1. The holding section has a same interval at the front end and the rear end. If the width of the power cord is greater than the interval of the holding section, the front end of the holding section will be pushed and extended, and the interval of the coupling section will be narrowed. Then a slight pulling will drag the power cord and the anchoring structure away from the power supply.

2. If the width of the power cord is smaller than the interval of the holding section, the power cord anchoring structure cannot clip the power cord and the anchoring function cannot be achieved. Another anchoring structure matching the width of the power cord should be used.

3. The coupling section is directly extended from the support section. When users force the coupling section to engage with the power supply, the clipping condition of the holding section and the maintaining section at the front end of the anchoring structure will be affected.

SUMMARY OF THE INVENTION

Therefore the primary object of the invention is to resolve the aforesaid disadvantages and overcome the drawbacks of the prior art. The invention provides a secured clipping for the power cord. It has a holding section to clip the power cord, a confining section to confine the power cord in the holding section, a support section and a connecting section linking in a biased manner, and a coupling section to engage with the power supply. The holding section at the front end of the anchoring structure can clip the power cord securely without affecting the engagement of the coupling section and the power supply.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
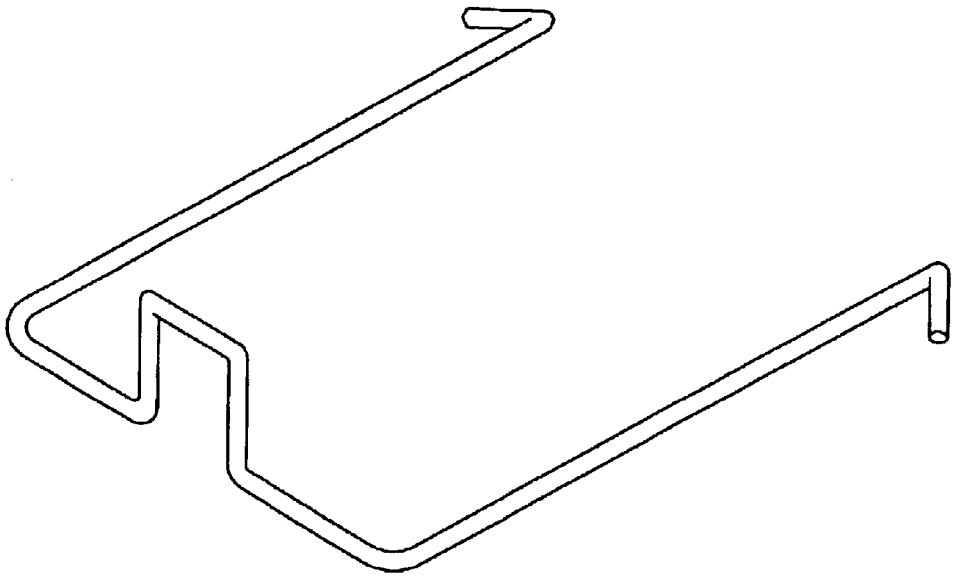
Fig.1 PRIOR ART
FIG. 1 is a perspective view of a conventional power cord anchoring structure.
Figure 2A:
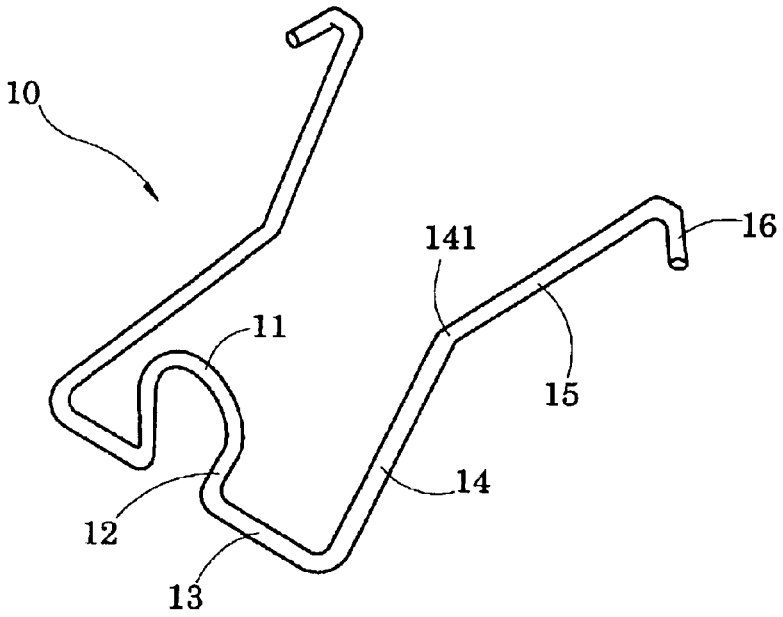
FIGS. 2A, 2B and 2C are perspective views of the invention from various angles.
Figure 2B:
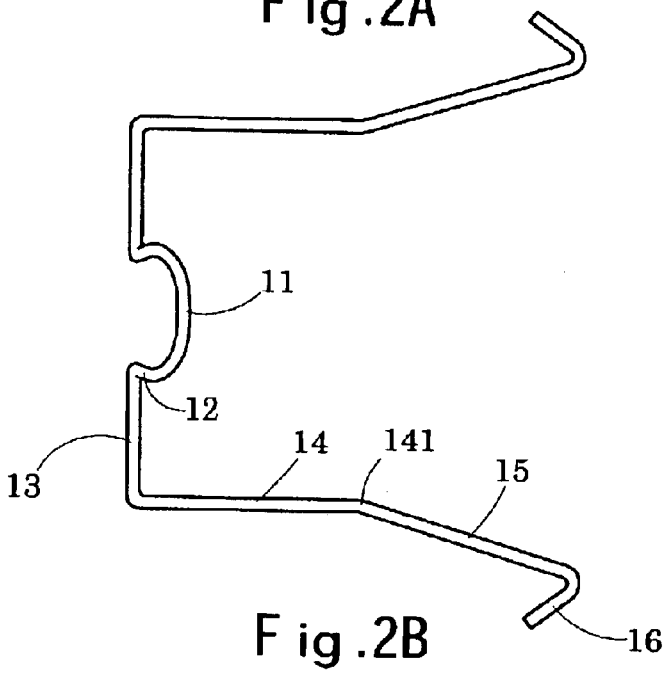
Figure 2C:
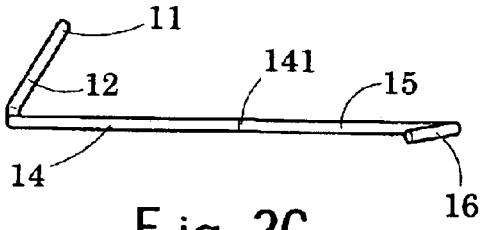

Please refer to FIGS. 2A, 2B and 2C for the perspective views of the present invention. The power cord anchoring structure 10 of the invention includes a holding section 11, a confining section 12 extending from the holding section 11 and having a smaller interval than the holding section 11, a maintaining section 13 extending from the confining section and being bent for an angle, a support section 14 extending from one end of the maintaining section 13 and being bent for a preset angle, a connecting section 15 formed by bending and extending the support section 14 at a turning point 141, and a coupling section 16 extending from the connecting section 15. The holding section 11 and the confining section 12 are bent rearwards to form an inclined condition against the plane formed by the maintaining section 13 and the support section 14. Such a structure enables the holding section 11 and the confining section 12 to form a secured clipping on a power cord 23 (referring to FIG. 3C). The power cord anchoring structure 10 is formed by an elastic and flexible material, generally is metal bent in an integrated manner to form the holding section 11, confining section 12, maintaining section 13, support section 14, connecting section 15 and coupling section 16.

Figure 3A:
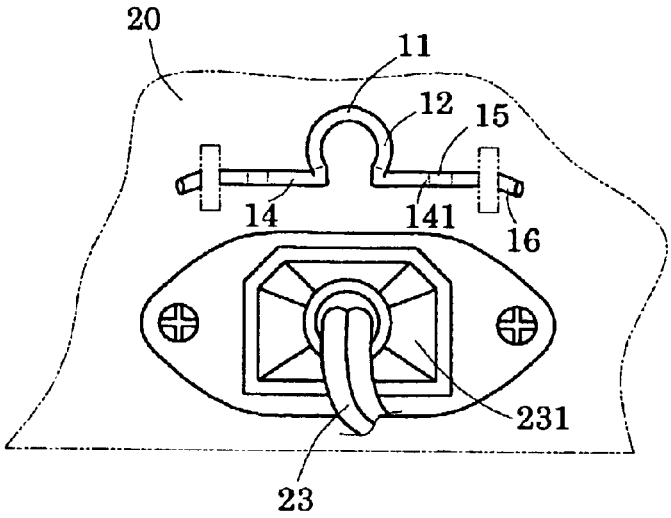
FIGS. 3A, 3B and 3C are schematic views of the invention in clipping conditions.
Figure 3B:
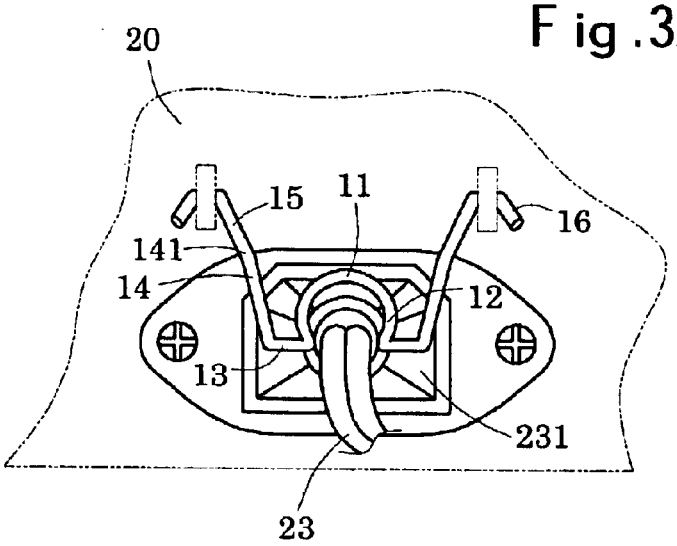
Figure 3C:
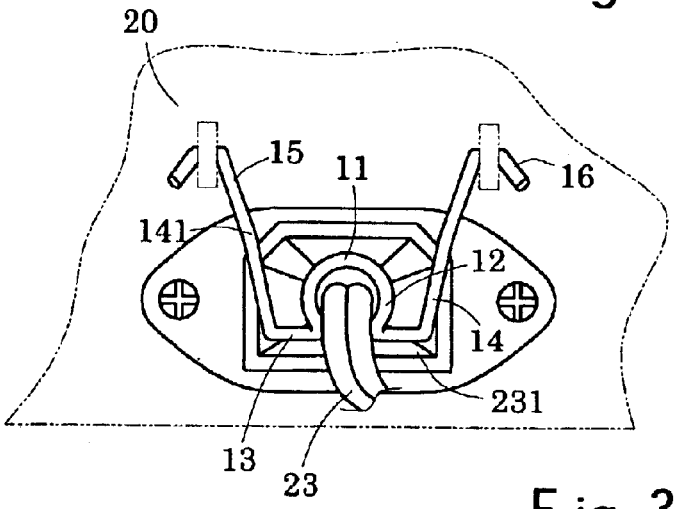

Refer to FIGS. 3A, 3B and 3C for the invention in clipping conditions. When in use, the holding section 11 clips the power cord 23. As the power cord 23 is usually made in a circular cross section, the holding section 11 may also be made in an arched form to mate the shape and diameter of the power cord 23. If the width of the power cord 23 is greater than the interval of the holding section 11 and the confining section 12, the confining section 12 will be pushed and extended during the clipping process to enable the holding section 11 to hold the power cord 23. As the turning point 141 divides the support sections 14 and the connecting section 15, extending of the holding section 11 and the confining section 12 affects only the interval of the support section 14, the interval of the coupling section 16 remains unchanged. Thus engagement of the coupling section 16 and the power supply 20 is not affected. In addition, the confining section 12 can retain the power cord 23 in the holding. section 11 without escaping. The width of the power cord 23 is not limited to be greater than the interval of the holding section 11. As long as the width of the power cord 23 is greater than the confining section 12, the power cord 23 will be confined in the holding section 11. The turning point 141 that divides the support section 14 and the connecting section 15 allows the connecting section 15 to be extended or retracted under forces so that only the interval of two ends of the coupling section 16 will be reduced to escape from the power supply 20, and the clipping condition of the holding section 11 at the front end of the anchoring structure 10 is not affected.

Figure 4:
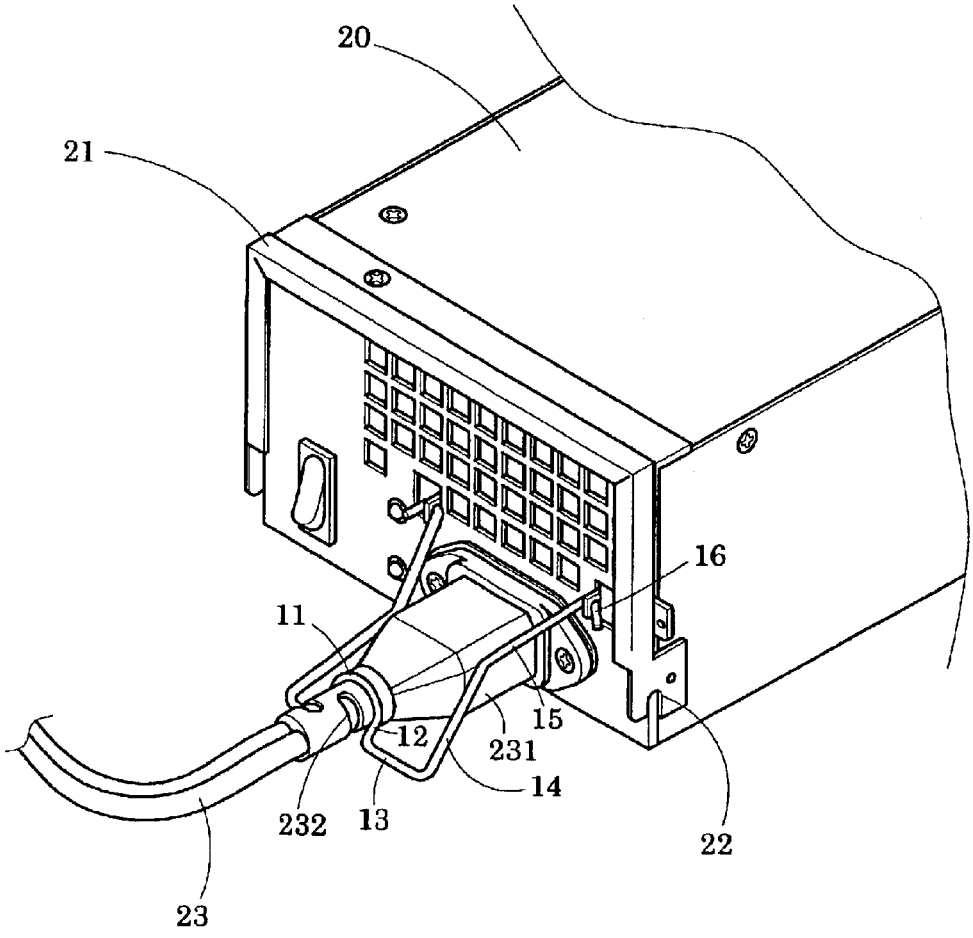
FIG. 4 is a pictorial view of an embodiment of the invention.

Refer to FIG. 4 for an embodiment of the invention. When the invention is used to clip the power cord 23, the holding section 11 is used to clip the power cord 23. There is usually a groove 232 formed between the power cord 23 and the plug 231. The groove 232 is formed by pliable plastics in order to achieve secured clipping. The confining section 12 extended from two ends of the holding section 11 can enhance coupling of the power cord 23 with the power supply 20. In addition, the power supply 20 has a handle 21 for retrieving the power supply 20. There is a safety latch groove 22 formed on the juncture of the handle 21 and the power supply 20. Only when the handle 21 is anchored on the power supply 20 can the anchoring structure 10 be separated from the power cord 23. When the handle 21 is separated from the power supply 20, the anchoring structure 10 cannot be separated from the power cord 23. Thus it can prevent accidents caused by operation negligence or children playing.

In summary, the invention has the following features:

1. When the width of the power cord 23 is greater than the holding section 11, the interval of the confining section 12 will be extended during clipping to enable the holding section 11 to hold the power cord 23. If the width of the power cord 23 is slightly smaller than the holding section 11, as long as it is greater than the confining section 12, the power cord 23 can still be confined in the holding section 11 by the confining section 12. Hence the anchoring structure 10 of the invention can accommodate a greater width range for the power cord 23.

2. With the turning point 141 dividing the support section 14 and the connecting section 15, when the interval of the holding section 11 or the confining section 12 is extended, the engagement of the coupling section 16 and the power supply 20 is not affected. On the other hand, applying forces on the connecting section 15 to control the engagement of the coupling section 16 and the power supply 20 does not affect the clipping of the holding section 11 at the front end of the anchoring structure 10.

3. The holding section 11 may match the shape of the power cord 23 to achieve secured clipping of the power cord 23.

What is claimed is:

1. A power cord anchoring structure for clipping a power cord, comprising:

a holding section for clipping the power cord;

a confining section extended from two ends of the holding section having an interval smaller than that of the holding section, the confining section being extended to form a maintaining section at a turning point;

a support section connected to one end of the maintaining section forming a selected angle with the maintaining section;

a connecting section formed by bending the support section and is divided from the support section at a turning point; and a coupling section connecting to the connecting section;

wherein the holding section clips the power cord, the confining section confining the power cord in the holding section, the turning point dividing the support section and the connecting section, the coupling section engaging with a power supply;

wherein engagement of the coupling section and the power supply is not affected by the clipping condition of the holding section at the front end of the anchoring structure.

2. The power cord anchoring structure of claim 1, wherein the holding section is shaped to correspond to the diameter of the power cord.

3. The power cord anchoring structure of claim 1, wherein the holding section and the confining section are bent rearwards to form an inclined condition with a plane formed by the maintaining section and the support section.

4. The power cord anchoring structure of claim 1, wherein the power supply has a handle located on a front end thereof, the handle and the power supply having a juncture which has a safety latch groove.

5. The power cord anchoring structure of claim 1, wherein the power cord anchoring structure is formed by bending an elastic and flexible material.

* * * * *